United States Patent [19]

Mezger et al.

[11] Patent Number: 4,909,213

[45] Date of Patent: Mar. 20, 1990

[54] ARRANGEMENT FOR ADJUSTING AN OPERATING CHARACTERISTIC QUANTITY OF AN INTERNAL COMBUSTION ENGINE

[75] Inventors: Manfred Mezger, Markgröningen; Guenther Plapp, Filderstadt; Frank Rodefeld, Möglingen, all of Fed. Rep. of Germany

[73] Assignee: Robert Bosch GmbH, Stuttgart, Fed. Rep. of Germany

[21] Appl. No.: 253,111

[22] Filed: Oct. 4, 1988

[30] Foreign Application Priority Data

Oct. 5, 1987 [DE] Fed. Rep. of Germany ..... 3733623

[51] Int. Cl.[4] ..... F02D 9/02

[52] U.S. Cl. ..... 123/339; 123/399

[58] Field of Search ..... 123/339, 585, 351, 586, 123/587, 588, 589, 630, 198 D; 251/133, 309, 311, 312, 319–323, 325

[56] References Cited

U.S. PATENT DOCUMENTS

| | | | |
|---|---|---|---|
| 4,350,802 | 11/1982 | Kern et al. | 123/339 |
| 4,494,517 | 1/1985 | Kratt et al. | 123/339 |
| 4,702,208 | 10/1987 | Lombard et al. | 123/339 |
| 4,705,001 | 11/1987 | Danno et al. | 123/339 |
| 4,763,623 | 8/1988 | Susaki | 123/339 |
| 4,790,276 | 12/1988 | Sasaki | 123/339 |
| 4,791,902 | 12/1988 | Ishikawa et al. | 123/399 |

*Primary Examiner*—Raymond A. Nelli

*Attorney, Agent, or Firm*—Walter Ottesen

[57] ABSTRACT

The invention is directed to an arrangement for adjusting an operating characteristic quantity of an internal combustion engine such as for the idle speed control with a redundant drive. Two windings of the drive are driven via two separate lines from two separate output stages. When a defect is detected via an electrical monitoring unit, a safety logic unit transfers the full operation for the drive of the throttle flap to the output stage and the winding corresponding thereto which are not affected by the defect. In this way, a noraml idle speed of the engine is assured even in the presence of a single defect.

15 Claims, 3 Drawing Sheets

60
-1-
ENGINE
10
11
13
13A
13B
70
34
34
35
-40A-
-40B-
40
-33A-
-33B-
-50-
51
-30-
-12-
31
32
-20-
22
23
SAFETY LOGIC UNIT
POSITION CONTROLLER
SPEED CONTROLLER
THROTTLE-FLAP ACTUAL-ANGLE EVALUATION UNIT

POTENTIAL MONITORING UNIT
+UB
33A
13
33A1
33A6
33A4
13A
-40A-
34
33A2
33A5
33A3
POTENTIAL MONITORING UNIT
+UB
33B
33B1
33B6
33B4
-40B-
34
13B
33B2
33B5
33B3
SAFETY LOGIC UNIT
70
POSITION CONTROLLER
22
51
- 50 -
-30 -
23

ARRANGEMENT FOR ADJUSTING AN OPERATING CHARACTERISTIC QUANTITY OF AN INTERNAL COMBUSTION ENGINE

FIELD OF THE INVENTION

The invention relates to an arrangement for adjusting an operating characteristic quantity of an internal combustion engine such as the idle air in the air intake pipe by means of an electromechanical actuator in dependence upon an influencing quantity such as idle air in the air intake pipe in dependence upon influence quantities such as engine speed, temperature and load condition. The actuator receives its drive signal from an electric control apparatus.

BACKGROUND OF THE INVENTION

An arrangement of the kind described above is disclosed in United Kingdom Pat. No. 2,007,878. In this patent, a simple electrical transmission of the actuator drive is described which is simple in the sense that it is without a safety arrangement. No provision is made for a defect in the drive arrangement so that the engine can die which is associated with a failure of power-assisted equipment such as self-energizing brakes, power steering and the like which makes the vehicle difficult to control.

On the other hand, an uncontrolled run up of the engine can occur. To prevent such problems, improvements have become known such as described in U.S. Pat. No. 4,494,517 wherein an actuator is disclosed which pivots to a defined opening cross section in the event of a failure of the drive. However, this solution too is not without problems since in the presence of different operating conditions such as temperature, air pressure and ancillary loads such as air conditioning, a fixed cross section cannot assure an idle operation for all conditions. Furthermore, United Kingdom Pat. No. 1,602,507 is representative of the state of the art wherein special drive motors are provided for actuators. In contrast, U.S. Pat. No. 4,356,802 discloses a special embodiment for actuators.

SUMMARY OF THE INVENTION

The arrangement according to the invention is for driving an actuator such as for the idle air in an air intake pipe. The invention affords the advantage that the above described disadvantages do not occur when a defect takes place; that is, and especially in the case of idle, the engine neither dies nor runs up to too high a speed. This is important especially in view of servo equipment such as self-energizing brakes and power steering because when the latter fail, a motor vehicle can only be controlled with difficulty. On the other hand, it is difficult to maintain constant desired idle speed in the presence of air-density variations, gear changes, accessory units such as air conditioning and other parameters which change. In addition to the application of the invention in connection with idle control or the throttle-flap positioning drive, it is also possible to drive other types of actuators with the same arrangement in connection with motor vehicle engines such as the control rod of the fuel pump of a diesel engine.

In addition to an advantageous mechanical separation of both systems against mechanical damage and scorching burns, the invention affords the advantageous possibility to provide a failure detection by monitoring the potential and/or current of the electrical leads. For the state of the art, only one failure announcement takes place and in contrast thereto and in an advantageous manner, the invention assures a continued normal operation of the vehicle.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
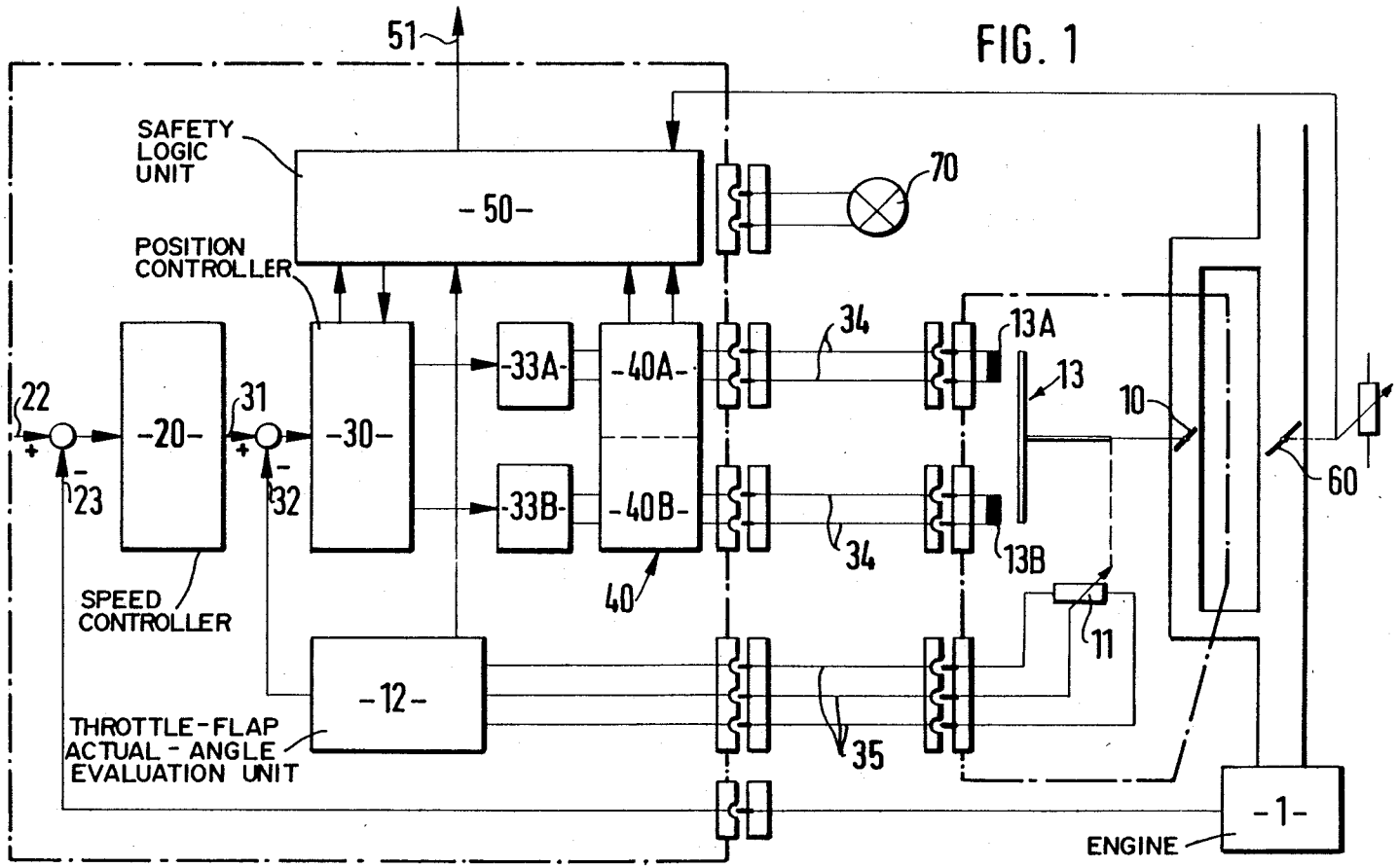
FIG. 1 is a special embodiment of the arrangement according to the invention showing the schematic circuit interconnecting the control apparatus and the drive for the bypass throttle flap.

The preferred embodiment of the invention is in the context of a motor vehicle with an internal combustion engine 1 as the drive. As shown schematically in FIG. 1, the idle control is provided with the aid of a bypass throttle flap 10. The bypass throttle flap 10 is driven by means of a cascade control. The first stage is a speed controller 20 which is supplied with a desired speed signal 22 and an actual speed signal 23 and which emits a desired position angle signal 31 for the bypass throttle flap. The actual position angle of the bypass throttle flap 10 is detected by means of a potentiometer 11 having terminals connected to a throttle-flap actual-angle evaluation unit 12. The bypass throttle flap desired value signal 31 and the actual value signal 32 are fed to a position controller 30. Two separate output stages 33A and 33B are connected to the position controller 30. The two output stages are connected with the two separate windings 13A and 13B of the actuator drive 13 for the bypass throttle flap 10. At the same time, the outputs of the two output stages 33A and 33B are supplied to an output stage potential monitoring unit 40.

A safety logic unit 50 is provided for monitoring the correct function of the control loop. This safety logic unit is supplied with the actual position of the main throttle flap 60 for detecting the idle condition. Furthermore, to detect the operating conditions, the output signal of the position controller 30 and the bypass throttle flap actual value from evaluation unit 12 are supplied to the safety logic unit 50. Furthermore, the signals of the output stage potential monitoring units 40A and 40B are supplied to the safety logic unit 50. From these signals, the safety logic unit 50 detects the presence of a defect when the latter occurs. In the event of a defect and in addition to emitting a failure signal 70 for the driver of the motor vehicle, the position controller 30 is so switched over that the output stage (33A, 33B), which is not affected by the defect, takes over the sole drive of the bypass throttle flap.

A further safety measure in the special embodiment shown, is the utilization of separate electrical leads 34 having separate plugs between the control apparatus on the one hand, and the bypass throttle flap drive 13 on the other hand. Also, the actual value status is made via a multi-lead separate line 35.

The circuit arrangement shown in FIG. 1 is a portion of the electrical engine control. In normal vehicle operation, the power control or control of the engine takes place via a main throttle flap 60 with control members corresponding thereto. Especially in the idle condition, the circuit arrangement shown is activated and a desired idle speed 22 is provided in dependence upon the influence quantities such as temperature, load condition, etcetera. The control of the idle speed of the engine occurs in the embodiment disclosed via a bypass throttle flap which is controlled by the above-described circuit arrangement in accordance with the desired speed.

Figure 2:
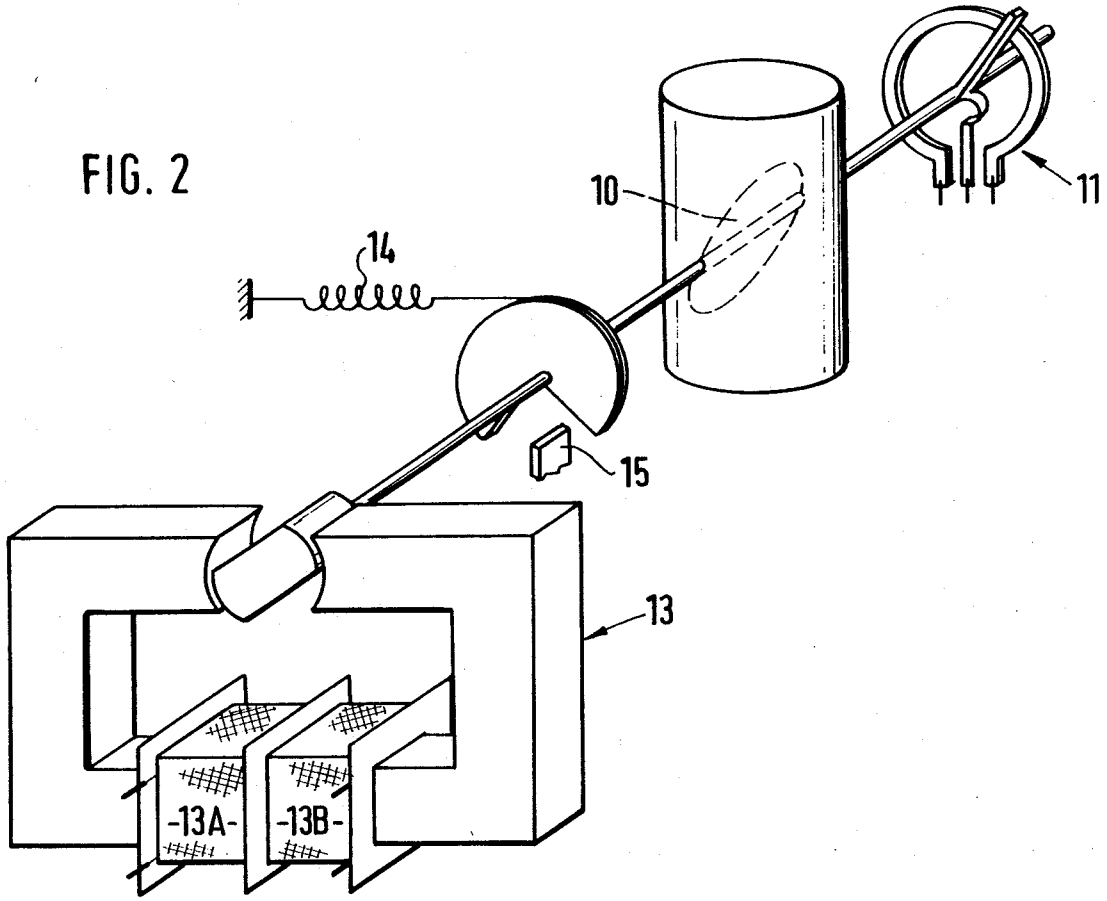
FIG. 2 is a perspective schematic showing the mechanical embodiment of an actuator drive according to the invention; and, FIG. 3 is a schematic showing a portion of the electrical circuit of the actuator drive.

FIG. 2 is a schematic of the mechanical drive of the bypass throttle flap valve 10. The mechanical drive includes the actual electromagnetic drive 13 with the two separate windings 13A and 13B operating in the same direction. The mechanical drive further includes a return spring 14 which pivots the throttle flap 10 to the largest possible opening in the zero current condition of the drive member 13. Further elements are the opening stop 15, the bypass throttle flap 10 itself and the actual position indicator in the form of a potentiometer 11.

Figure 3:
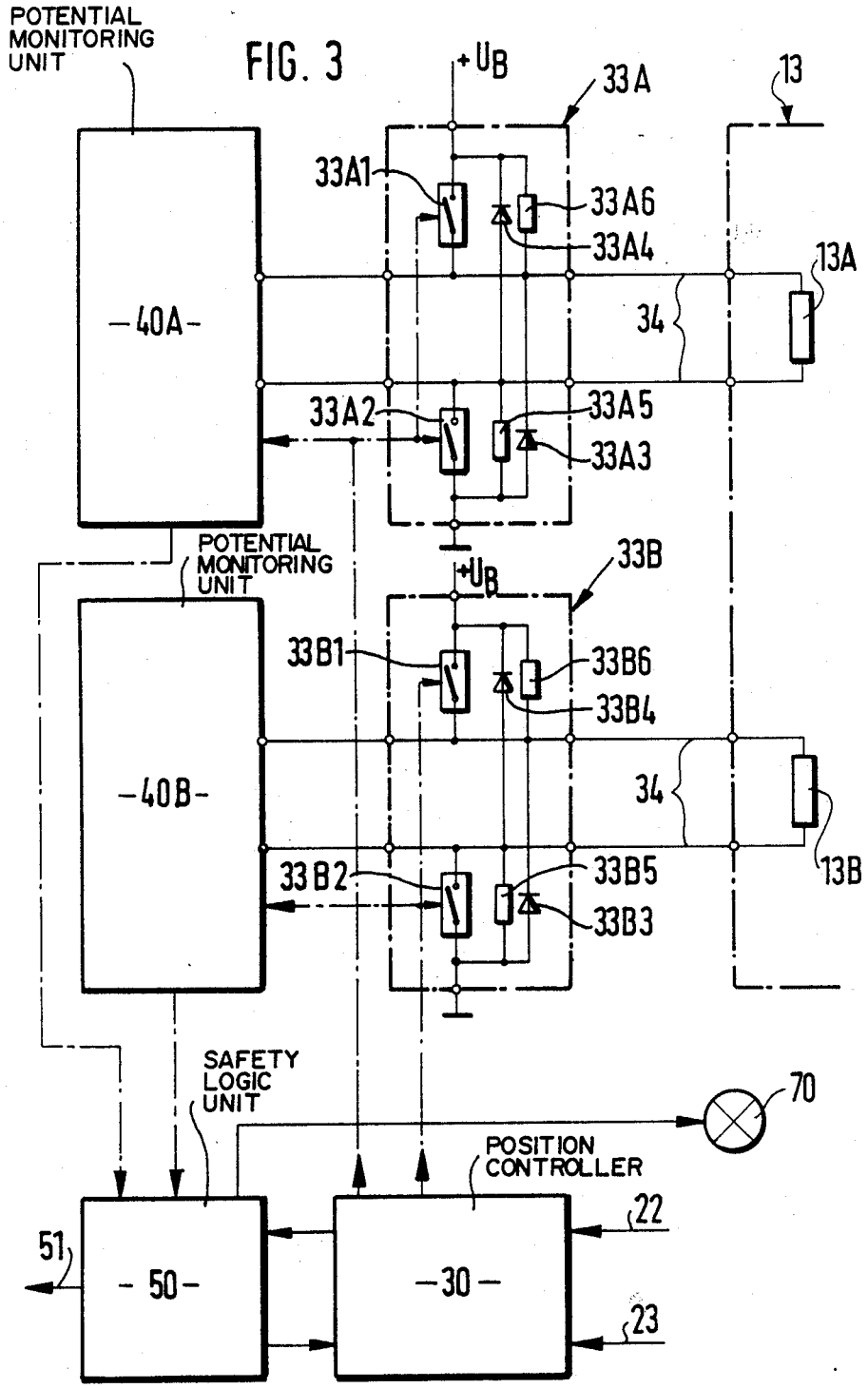

FIG. 3 shows the circuit configuration of the output stages in detail. Each of the two output stages 33A and 33B together with respective ones of the windings 13A and 13B of the actuator drive 13 form a series circuit between the plus pole of the current supply $U_B$ and the ground potential G. Each of the two series circuits includes a switch 33A1 and 33B1; the input lead 34 to the winding of the actuator drive; the winding of the actuator drive 13A and 13B; the return lead 34 from the actuator drive 13 to the output stage 33A and 33B; and, the second switch 33A2 and 33B2 to ground potential. These switches are realized by means of electronic components.

To protect the electronic switches and to provide a faster decay of the magnetic energy stored in the actuator, free-wheeling diodes (33A3, 33A4) and (33B3, 33B4) are provided in each of the two output stages. The two switches in each stage are each bridged by a resistor (33A5, 33A6) and (33B5, 33B6) which has a high resistance compared to the internal resistance of the winding. In this way, a potential of approximately half the supply voltage is provided at the outputs of the output stages when the switches are open.

In contrast to the above, if both switches are closed, that is the drive winding is driven, the two outputs of the respective output stages are approximately at ground potential or at the supply voltage. This performance is utilized for the potential monitoring unit 50A and 50B. If the self-adjusting potentials do not correspond to the potentials expected pursuant to the command, this condition is recognized by the safety logic unit 50 as a defect. In response to this condition and pursuant to the invention, the affected output stage 33A or 33B is switched off and the output signals of the position controller 30 can be so modified that the other one of the two output stages (33A or 33B) can take over the idle control completely on its own.

In the embodiment shown, a provision is made for the unlikely case of a simultaneous failure of both position drive paths. In this case, the spring 14 pulls the bypass throttle flap 10 into its open position. The fuel metering is then reduced (signal 51) inorder to prevent a run up of the engine. On the other hand, an emergency idle operation of the vehicle is even then possible.

Special further advantages of the invention include the utilization of the entire positioning range exclusively for the active positioning stroke since no lost motion for emergency operation is available. The zero-current opening assures an adequate quantity of starting air in cold weather and prevents a freeze-up of the actuator. Furthermore, the double operating capability (two windings) available in normal operation makes a jamming because of dirtying substantially more unlikely.

It is understood that the arrangement according to the invention is not limited to the application in connection with a bypass throttle flap; instead, it can just as well be utilized for the main throttle flap.

Furthermore, the invention is also usable in combination with an actuator such as for the positioning of a control rod. For this reason, it is desirable for all the cases mentioned above that a fail indication 70 be provided which is recognizable by the driver and/or maintenance personnel.

It is understood that the foregoing description is that of the preferred embodiments of the invention and that various changes and modifications may be made thereto without departing from the spirit and scope of the invention as defined in the appended claims.

What is claimed is:

1. An arrangement for adjusting an operating characteristic quantity of an internal combustion engine such as the idle air in the air intake pipe of the engine, the operating characteristic quantity being adjusted in dependence upon an influencing quantity such as engine speed, temperature and load condition, the arrangement comprising:

a controllable member displaceable for adjusting the operating characteristic quantity;

an electromechanical actuator for displaceably actuating the controllable member for adjusting the operating characteristic quantity;

first and second electrically separate drive units for receiving first and second drive currents, respectively, for driving the actuator; and, a control apparatus including:

electrically separate first and second output stages connected to corresponding ones of said first and second drive units for supplying said first and second drive currents thereto, respectively;

output stage monitoring means for monitoring the outputs of said output stages;

a controller for supplying a control signal in dependence upon the actual and desired values of one of said influencing quantities;

a position controller for receiving said control signal and for supplying first and second output signals to said first and second output stages, respectively;

said controllable member, said electromechanical actuator and said control apparatus conjointly defining a control loop;

control loop monitoring means for monitoring the operation of said control loop for a defect which could adversely affect one of said output stages;

position detecting means for detecting the actual position of said controllable member; and, said control loop monitoring means being connected to said position detecting means, said position controller and said output stage monitoring means for detecting the presence of a defect and modifying said output signals of said position controller so as to permit the output stage unaffected by said defect to take over the operation of said controllable member.

2. The arrangement of claim 1, said first and second drive units being first and second drive coils, respectively, wound so as to act in the same direction.

3. The arrangement of claim 2, said coils being dimensioned so that each coil can drive said controllable member through at least the major portion of its operating range without the participation of the other coil.

4. The arrangement of claim 1, comprising: a first set of plugable interconnecting leads for interconnecting said first output stage and said first drive unit; and, a second set of plugable interconnecting leads for interconnecting said second output stage and said second drive unit.

5. The arrangement of claim 1, comprising a third set of plugable leads for interconnecting said control apparatus and said position detection means.

6. The arrangement of claim 1, said monitoring means including means for operating on said position controller and said output stages in response to a defect so as to cause the one output stage affected by the defect to be switched off and the other output stage to take over the complete drive of said controllable member via the drive unit connected to said other output stage.

7. The arrangement of claim 1, the engine being the engine of a motor vehicle; and, said monitoring means including an indicator for providing the driver of the vehicle with an indication of the defect.

8. The arrangement of claim 1, comprising return means for returning said controllable member to a predetermined position in the presence of a zero current condition in said drive units.

9. The arrangement of claim 8, said controllable member being movable between a closed position and an open position; and, said return means being arranged to move said controllable member into said open position in response to said zero current condition.

10. The arrangement of claim 1, said one influencing quantity being engine speed; and, said monitoring means including a safety logic unit for reducing the fuel metered to the engine.

11. The arrangement of claim 1, each of said output stages being connected to the drive unit corresponding thereto by a current supply line and a current return line; each of said output stages comprising a series circuit connected across said lines, said series circuit including a first electrical switch, a set of terminals connected to said drive unit; and, a second electrical switch; said series circuit further including two resistors connected in parallel with respective ones of said switches; and, detection means for detecting the potential on said lines.

12. The arrangement of claim 1, wherein the air intake pipe contains a main throttle flap and is part of an air intake system which includes a bypass channel connected in parallel with said air intake pipe; said arrangement being for an idle control system including said controllable member in the form of a bypass throttle flap pivotally mounted in said bypass channel.

13. The arrangement of claim 1, wherein the arrangement is utilized in a system having an electrically influenceable throttle flap mounted in the air intake pipe.

14. An arrangement for adjusting the idle air in the air intake pipe of an internal combustion engine, the idle air being adjusted in dependence upon the engine speed, the arrangement comprising:

a controllable member displaceable for adjusting the idle air;

an electromechanical actuator for displaceably actuating the controllable member for adjusting the idle air;

first and second electrically separate drive units for receiving first and second drive currents, respectively, for driving the actuator; and, a control apparatus including:

electrically separate first and second output stages connected to corresponding ones of said first and second drive units for supplying said first and second drive currents thereto, respectively;

output stage monitoring means for monitoring the outputs of said output stages;

a speed controller for supplying a control signal in dependence upon the actual and desired values of the engine speed;

a position controller for receiving said control signal and for supplying first and second output signals to said first and second output stages, respectively;

said controllable member, said electromechanical actuator and said control apparatus conjointly defining a control loop;

control loop monitoring means for monitoring the operation of said control loop for a defect which could adversely affect one of said output stages;

position detecting means for detecting the actual position of said controllable member; and, said control loop monitoring means being connected to said position detecting means, said position controller and said output stage monitoring means for detecting the presence of a defect and modifying said output signals of said position controller so as to permit the output stage unaffected by said defect to take over the operation of said controllable member.

15. An arrangement for adjusting an operating characteristic quantity of an internal combustion engine such as the idle air in the air intake pipe of the engine, the operating characteristic quantity being adjusted in dependence upon an influencing quantity such as engine speed, temperature and load condition, the arrangement comprising:

a controllable member displaceable for adjusting the operating characteristic quantity;

an electromechanical actuator for displaceably actuating the controllable member for adjusting the operating characteristic quantity;

drive means for receiving first and second drive currents for driving the actuator; and, a control apparatus including:

electrically separate first and second output stages connected to said drive means for supplying said first and second drive currents thereto, respectively;

output stage monitoring means for monitoring the outputs of said output stages;

a controller for supplying a control signal in dependence upon the actual and desired values of one of said influencing quantities;

a position controller for receiving said control signal and for supplying first and second output signals to said first and second output stages, respectively;

said controllable member, said electromechanical actuator and said control apparatus conjointly defining a control loop;

control loop monitoring means for monitoring the operation of said control loop for a defect which could adversely affect one of said output stages;

position detecting means for detecting the actual position of said controllable member; and, said control loop monitoring means being connected to said position detecting means, said position controller and said output stage monitoring means for detecting the presence of a defect and modifying said output signals of said position controller so as to permit the output stage unaffected by said defect to take over the operation of said controllable member.

* * * * *